US006749354B2

(12) United States Patent
Kageyama et al.

(10) Patent No.: US 6,749,354 B2
(45) Date of Patent: Jun. 15, 2004

(54) COMPOSITE WRITING IMPLEMENT

(75) Inventors: Hidehei Kageyama, Saitama-ken (JP); Yoshio Noguchi, Saitama-ken (JP)

(73) Assignee: Kotobuki & Co., Ltd., Kyoto-fu (JP)

( * ) Notice: Subject to any disclaimer, the term of this patent is extended or adjusted under 35 U.S.C. 154(b) by 0 days.

(21) Appl. No.: 10/214,162

(22) Filed: Aug. 8, 2002

(65) Prior Publication Data

US 2003/0215278 A1 Nov. 20, 2003

(30) Foreign Application Priority Data

Apr. 26, 2002 (JP) ..... 2002-125379

(51) Int. Cl.[7] ..... A47L 11/08; B05C 1/00
(52) U.S. Cl. ..... 401/21; 401/17; 401/19
(58) Field of Search ..... 401/21, 17, 19, 401/20, 243, 258

(56) References Cited

U.S. PATENT DOCUMENTS 1,632,710 A * 6/1927 Morris ..... 401/151
2,367,683 A * 1/1945 Lopez ..... 15/105.51
4,352,579 A * 10/1982 Yi ..... 401/19
6,227,743 B1 * 5/2001 Robb ..... 401/243
6,450,721 B1 * 9/2002 D'Amico et al. ..... 401/258

* cited by examiner

*Primary Examiner*—David J. Walczak
(74) *Attorney, Agent, or Firm*—Rothwell, Figg, Ernst & Manbeck

(57) ABSTRACT

A composite writing implement is capable of being used as a ball-point pen, a mechanical pencil or a stylus pen. The composite writing implement includes a barrel, a pencil lead feeder unit axially slidably placed in a front part of the barrel, a ballpoint refill unit disposed behind and coaxially with the pencil lead feeder unit in a back part of the barrel and including a ballpoint refill case and a ballpoint refill fixedly held in the ballpoint refill case, a rotary cam operatively connecting the ballpoint refill case and the pencil lead feeder unit, and a cap put on the ballpoint refill case so as to cover the ballpoint tip of the ballpoint refill, provided with a stylus tip, capable of being used as a stylus and means for turning the rotary cam through the ballpoint refill case to make the pencil lead feeder feed a lead.

2 Claims, 12 Drawing Sheets

COMPOSITE WRITING IMPLEMENT

BACKGROUND OF THE INVENTION

1. Field of the Invention

The present invention relates to a composite writing implement provided with a pencil lead feeder, a ballpoint refill and a stylus in a coaxial arrangement or two ballpoint refills and a stylus in a coaxial arrangement.

2. Description of the Related Art

There have been composite writing implements of this type provided with at least two writing elements, such as a pencil lead feeder and a stylus pen, or a ballpoint refill and a stylus. In the conventional composite writing implement provided with at least two writing elements, such as a pencil lead feeder and a stylus, or a ballpoint refill and a stylus, the two writing elements are placed side by side in a barrel and are projected alternately from the barrel. Thus, the conventional composite writing implement inevitably needs many parts and has a complicated mechanism, and the barrel has a big diameter. Consequently, it has been difficult to provide a reliable composite writing implement of such conventional construction having a small diameter and easy to operate.

SUMMARY OF THE INVENTION

Accordingly, it is an object of the present invention to provide a reliable composite writing implement provided with three coaxially arranged writing elements, including a comparatively small number of parts and easy to operate.

Another object of the present invention is to provide a very useful composite writing implement provided with a pencil lead feeder, a ballpoint refill and a stylus, in which the stylus can be used as a cap for covering the ballpoint refill and as a pencil lead feeder operating member without impeding its intrinsic function, and can be put on a barrel cap to use both the ballpoint refill and the stylus of the composite writing implement.

According to a first aspect of the present invention, a composite writing implement includes: a barrel, a pencil lead feeder unit axially slidably placed in the barrel, a ballpoint refill unit disposed behind and coaxially with the pencil lead feeder unit in the barrel, an interlocking means for interlocking the pencil lead feeder unit and the ballpoint refill unit, and a cap, provided with a stylus tip, for covering a ballpoint tip of the ballpoint refill.

According to a second aspect of the present invention, a composite writing implement includes a barrel provided with a detachable barrel cap, a first ballpoint refill placed in the barrel, a second ballpoint refill disposed behind the first ballpoint refill in the barrel, a ballpoint refill case placed in the barrel and holding the second ballpoint refill therein, an interlocking means for interlocking the first ballpoint refill and the ballpoint refill case holding the second ballpoint refill, and a stylus serving also as a cap for covering a tip of the second ballpoint refill and an operating member for turning the ballpoint refill case holding the second ballpoint refill therein to make the tip of the first ballpoint refill project from the barrel.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

Figure 1:
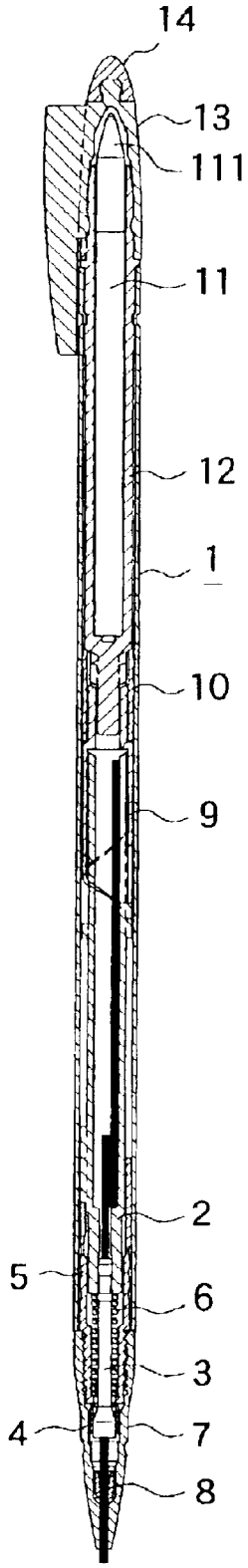
FIG. 1 is a longitudinal sectional view of a composite writing implement in a first embodiment according to the present invention.

Referring to FIG. 1 showing a composite writing implement in a first embodiment according to the present invention, a pencil lead feeder is placed in a unitary barrel 1 of an outside diameter in the range of 3 to 8 mm.

Figure 2:
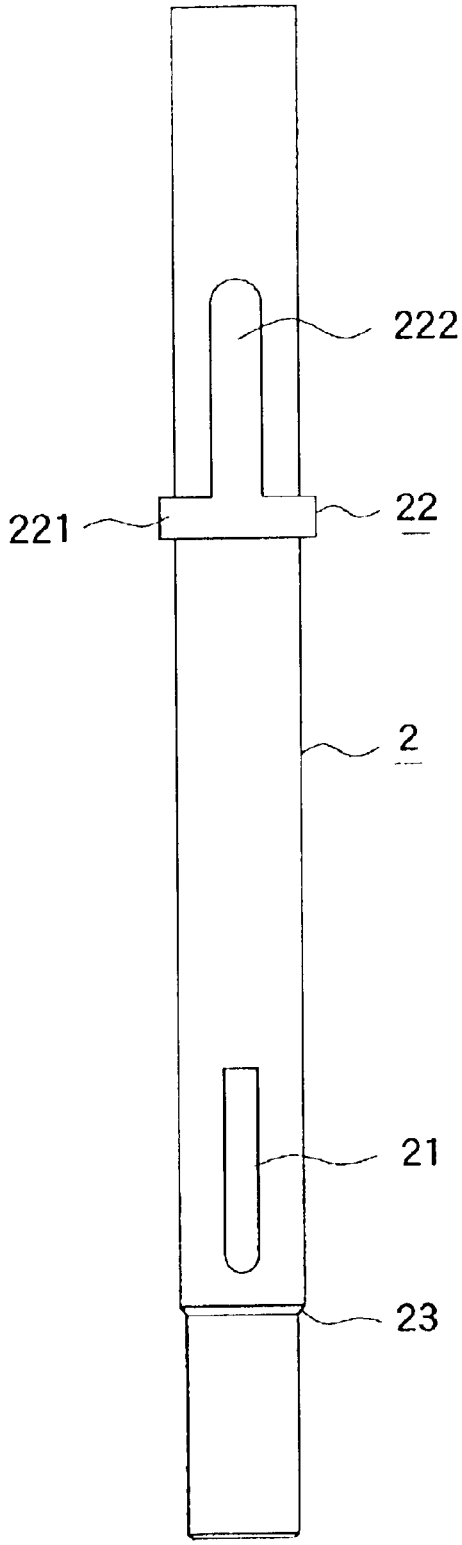
FIG. 2 is an enlarged front elevation of a lead tank included in the composite writing implement shown in FIG. 1.
Figure 3:
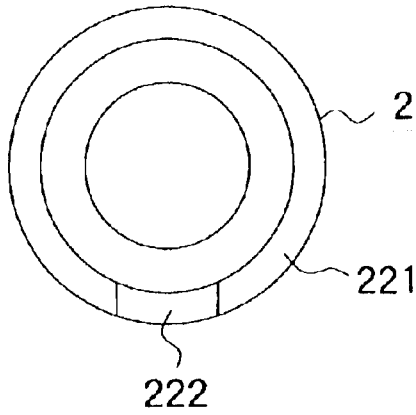
FIG. 3 is an enlarged top view of the lead tank shown in FIG. 2.
Figure 4:
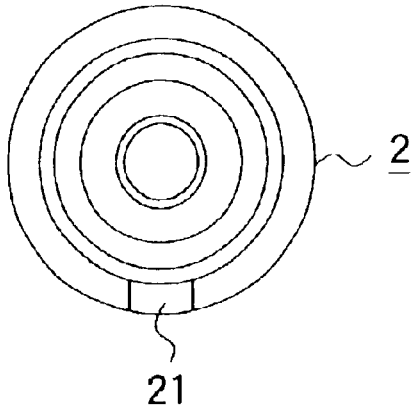
FIG. 4 is an enlarged bottom view of the lead tank shown in FIG. 2.

A lead tank 2 containing two leads is placed for axial sliding movement in the barrel 1. As shown in FIGS. 2 to 4, a longitudinal retaining rib 21 having a round front end is formed on a front part of the circumference of the lead tank 2. A follower rib 22 engaged with a rotary cam member 9, which will be described later, is formed in a back part of the circumference of the lead tank 2. The follower rib 22 has an annular rib 221, and a longitudinal rib 222 extending backward from the annular rib 221 and having a round back end. The lead tank 2 is provided with a shoulder 23 in the circumference of a front part thereof.

A back end part of a chuck 3 is fixedly pressed in a front end part of the lead tank 2. Naturally, the chuck 3 may be indirectly connected to the lead tank 2 by a connecting member. A chuck ring 4 is put loosely on a front chucking part of the chuck 3. A metal sleeve 5 shown in FIG. 5 having a reduced front part provided with an external thread 51 is fixedly fitted in a front part of the barrel 1 so as to surround the chuck 3.

Figure 5:
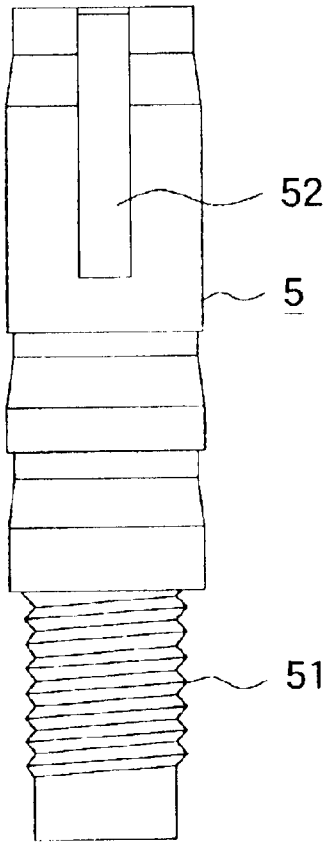
FIG. 5 is an enlarged front elevation of a sleeve included in the composite writing implement shown in FIG. 1.
Figure 6:
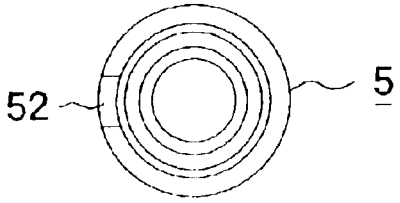
FIG. 6 is an enlarged top view of the sleeve shown in FIG. 5.

Referring to FIGS. 5 and 6, a longitudinal expanding slot 52 is formed in a back end part of the sleeve 5. A chuck spring 6 is compressed between a shoulder formed in the inner circumference of a front end part of the sleeve 5 and the front end surface of the lead tank 2 to push the lead tank 2 together with the chuck 3 backward. In this state, the chuck ring 4 engages closely with the front chucking part of the chuck 3 to make the chuck hold a lead.

A barrel cap 7 is screwed on the front reduced part provided with the external thread 51 of the sleeve 5. A rubber packing 8, namely, a friction member for holding the lead, is fitted in the barrel cap 7. The rotary cam member 9 is put on the back part of the lead tank 2. When the rotary cam member 9 is turned, the rotary cam member 9 advances the lead tank 2 against the resilience of the chuck spring 6.

Figure 7:
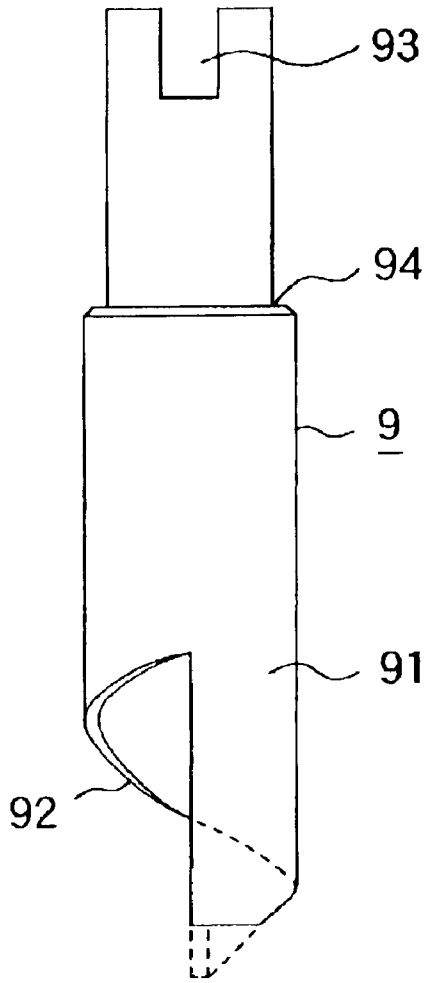
FIG. 7 is an enlarged front elevation of a rotary cam member included in the composite writing implement shown in FIG. 1.
Figure 8:
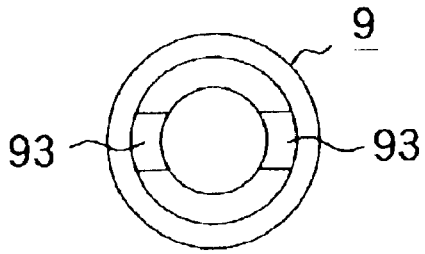
FIG. 8 is an end view of the rotary cam member shown in FIG. 7.
Figure 9:
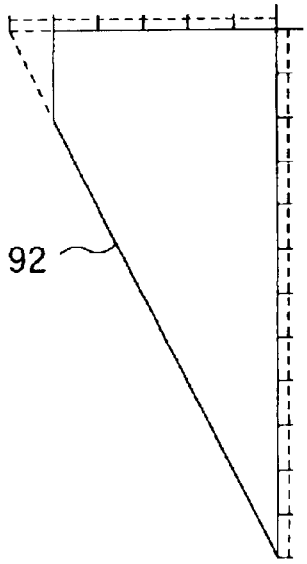
FIG. 9 is a development of the rotary cam member shown in FIG. 7.

FIGS. 7 to 9 show the rotary cam member 9 that can be turned only in one direction by turning a cap 13, i.e., a turning means. The rotary cam member 9 has a tubular cam body 91, a face cam part 92 formed in the front end of the cam body 91. Slots 93 are formed in a back end part of the cam body 91. A shoulder 94 is formed in the outer circumference of the rotary cam member 9.

Figure 10:
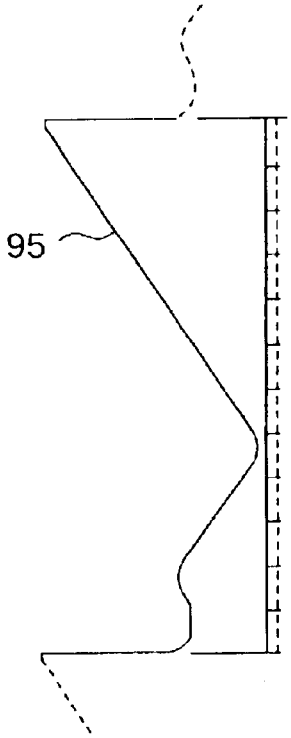
FIG. 10 is a development of a rotary cam member in a modification of the rotary cam member shown in FIG. 7.

FIG. 10 is a development of face cam 95 having a plurality of peaks and formed in a rotary cam member in a modification of the rotary cam member 9 shown in FIG. 7. The face cam 95 of this rotary cam member permits the cap 13 to turn in opposite directions to operate the pencil lead feeder.

Figure 11:
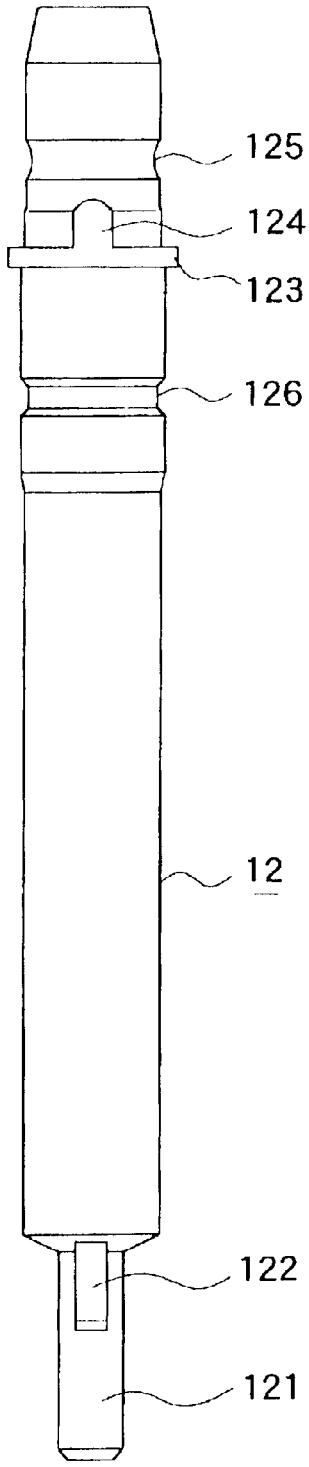
FIG. 11 is front elevation of a ballpoint refill case included in the composite writing implement shown in FIG. 1.
Figure 12:
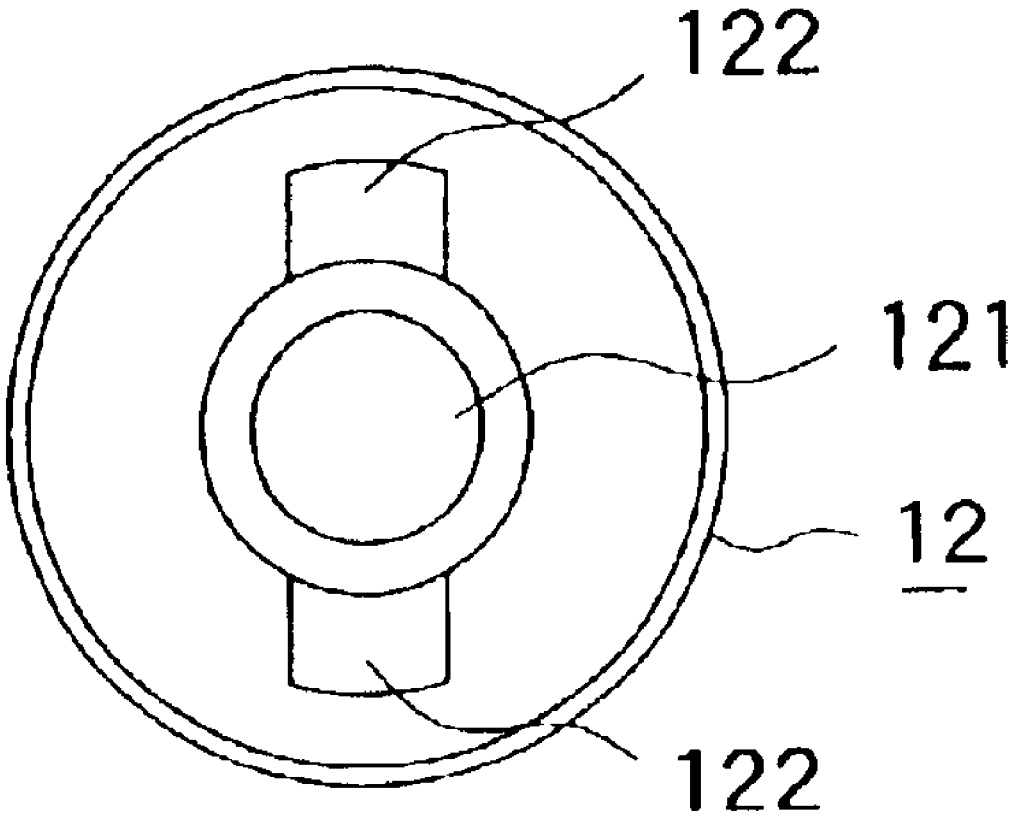
FIG. 12 is an enlarged end view of the ballpoint refill case shown in FIG. 11.
Figure 13:
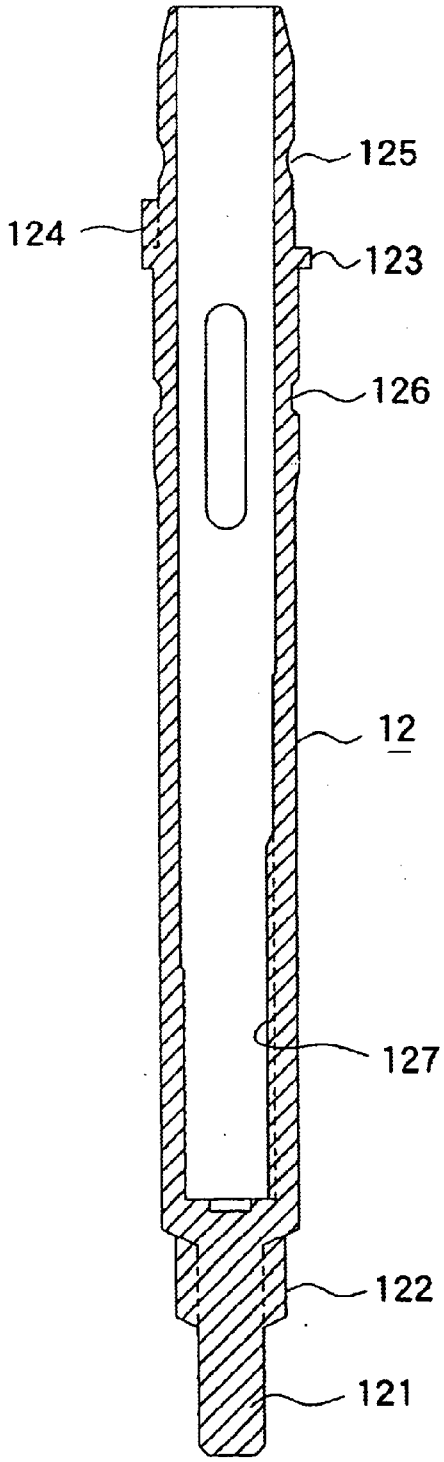
FIG. 13 is a longitudinal sectional view of the ballpoint refill case shown in FIG. 11.
Figure 14:
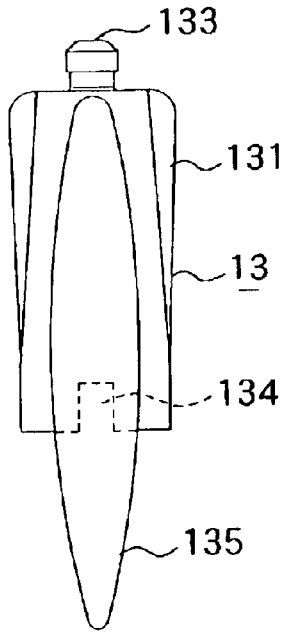
FIG. 14. is a an enlarged front elevation of a cap body included in the composite writing implement shown in FIG. 1.
Figure 15:
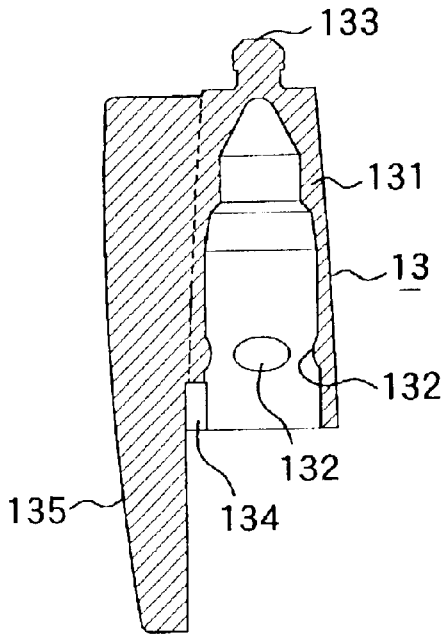
FIG. 15 is a longitudinal sectional view of the cap body shown in FIG. 14.
Figure 16:
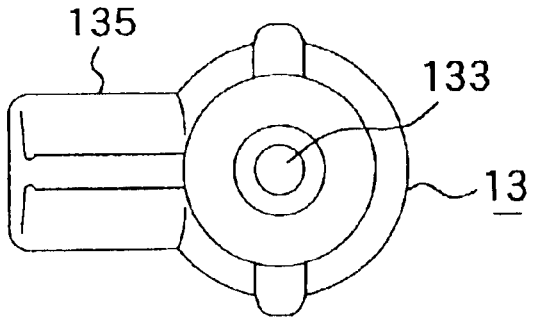
FIG. 16 is a top view of the cap body shown in FIG. 14.
Figure 17:
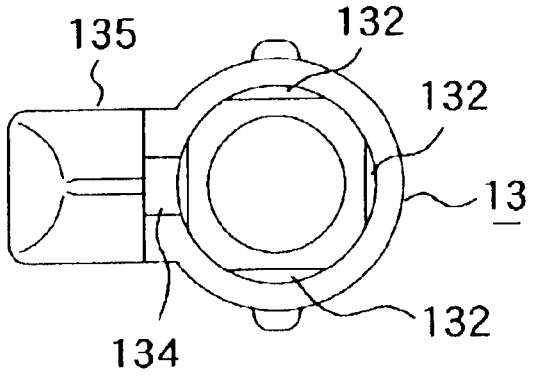
FIG. 17 is a bottom view of the cap body shown in FIG. 14.

A stopper tube 10 made of metal is fixedly fitted in a part, corresponding to the rotary cam member 9, of the barrel 1. A ballpoint refill case 12 is extended behind the rotary cam member 9. Stopper tube 10 may be fixedly held in barrel 1 to position ballpoint refill case 12 in place. A ballpoint refill 11 is pressed in the ballpoint refill case 12 through the open back end of the ballpoint refill case 12. As shown in FIGS. 11 to 13, the ballpoint refill case 12 has a reduced front end part 121, and two ribs 122 longitudinally extending from the back end of the reduced front end part 121.

An annular positioning rib 123 is formed on a part, near a ballpoint tip 111 (FIG. 1), of the ballpoint refill case 12. The annular positioning rib 123 rests on the back end surface of the barrel 1 to prevent the ballpoint refill case 12 from sinking in the barrel 1. As shown in FIG. 11, a rib 124 is extended backward from the annular rib 123. The rib 124 has a round back end to facilitate the insertion of the rib 124 in a groove 134 formed in the cap 13.

An annular groove 125 is formed in a part, behind the rib 124, of the ballpoint refill case 12. Four projections 132 formed in the inner surface of the cap 13 at equal angular intervals engage in the annular groove 125 to retain the cap 13 on the ballpoint refill case 12. An annular groove 126 is formed in a part, in front of the annular rib 123, of the ballpoint refill case 12.

As shown in FIG. 13, a longitudinal holding rib 127 is formed on the inner surface of a front part of the ballpoint refill case 12 to hold the ballpoint refill 11 securely in the ballpoint refill case 12. An annular ridge is formed in the inner surface of the barrel 1 at a position corresponding to the annular groove 126 of the ballpoint refill case 12 as fitted in the barrel 1. The annular ridge of the barrel 1 engages in the annular groove 126 to hold the ballpoint refill case 12 detachably in the barrel 1. The cap 13 provided with a clip is detachably put on a back part of the ballpoint refill case 12 with the four projections 132 thereof engaged in the annular groove 125 of the ballpoint refill case 12.

Referring to FIGS. 14 to 17, the cap 13 has a cap body 131 and a clip 135. The cap body 131 is provided with the four projections 132 arranged on the inner surface thereof at equal angular intervals. A stylus tip holding projection 133 is formed on the top of the cap body 131. A stylus tip 14 is put on the tip holding projection 133. When the cap 13 is put on the ballpoint refill case 12, the rib 124 of the ballpoint refill case 12 engages in the groove 134 of the cap 13. Thus, the turning motion of the cap 13 can be transmitted to the rotary cam member 9. Thus, the cap 13 includes the cap body 131, the clip 135, and the stylus tip 14 firmly put on the stylus tip holding projection 133. The cap 13 and the ballpoint refill case 12 are restrained from turning relative to each other by a restraining mechanism consisting of the rib 124 and the cap body 131 provided with the groove 134.

The rib 124 formed in a part, corresponding to a base part of the ballpoint tip 111, of the ballpoint refill case 12 engages in the groove 134 of the cap body 131. Thus, the cap 13 is restrained from turning relative to the ballpoint refill case 12 and is allowed to be removed from the ballpoint refill case 12. The lead tank 2 can be advanced by the rotary cam member 9 by turning the cap 13 and transmitting the turning motion of the cap 13 through the ballpoint refill case 12 to the rotary cam member 9.

The operation of the composite writing implement in the first embodiment will be described. When the composite writing implement is used as a mechanical pencil, the cap 13 is turned in a direction. Then, the ballpoint refill case 12 turns because the rib 124 thereof is engaged in the groove 134 of the cap 13. Since the two ribs 122 formed in the front part of the ballpoint refill case 12 are engaged in the slots 93 of the rotary cam member 9, the rotary cam member 9 is turned when the ballpoint refill case 12 is thus turned, and the face cam 92 of the rotary cam member 9 engaged with the follower rib 22 exerts a force on the follower rib 22 of the lead tank 2. Since the lead tank 2 is restrained from turning by the engagement of the rib 21 thereof and the groove 52 of the sleeve 5, the lead tank 2 advances together with the chuck 3 connected to the lead tank 2.

As the chuck 3 is thus advanced, the chuck ring 4 comes into contact with the shoulder formed in the barrel cap 7 and is separated from the chuck 3. Consequently, the chuck 3 opens to feed the lead. When the turning operation for turning the cap 13 is stopped, the chuck 3 is retracted, the chuck ring 4 engages with the chuck 3 to make the chuck 3 hold the lead. When it is desired to put back the lead into the composite writing implement, the cap 13 is turned to open the chuck 3, and the lead is pushed back into the lead tank 2.

If the rotary cam member 9 has the face cam 95, shown in FIG. 10, which permits the cap 13 to turn in opposite directions, allowing the cap 13 to turn in a direction opposite to a direction of the lead feeding operation opens the chuck 3, which makes it possible to push back the lead into the lead tank 2.

When the leads are depleted, the cap 13 and the ballpoint refill case 12 are extracted from the barrel, and spare leads are supplied through the open back end of the barrel 1 to replenish the lead tank 2 with spare leads, the ballpoint refill case 12 is inserted in the barrel, and then the cap 13 is put on the ballpoint refill case 12. When the composite writing implement is used as a ballpoint pen, the cap 13 is removed from the ballpoint refill case 12 to expose the ballpoint tip 111 of the ballpoint refill 11, and the barrel 1 is inverted to write with the ballpoint refill 11.

Dimensions of the engaging parts of the cap 13, the ballpoint refill case 12 and the rotary cam member 9 are determined such that the tightness of a fit between the cap 13 and the ballpoint refill case 12 is lower than that of a fit between the ballpoint refill case 12 and the rotary cam member 9 to prevent the ballpoint refill case 12 from being extracted from the barrel 1 when the cap 13 is pulled to remove the same from the ballpoint refill case 12.

When the composite writing implement is used as a stylus pen, the stylus tip 14 is put on the stylus tip holding projection 133 of the cap 13, and the barrel 1 is inverted to use the composite writing implement as a stylus pen. When it is desired to use the composite writing instrument as both a ballpoint pen and a stylus pen, the cap 13 is removed from the ballpoint refill case 12 to expose the ball-point tip 111, and the cap 13 is put on the barrel cap 7.

Figure 18:
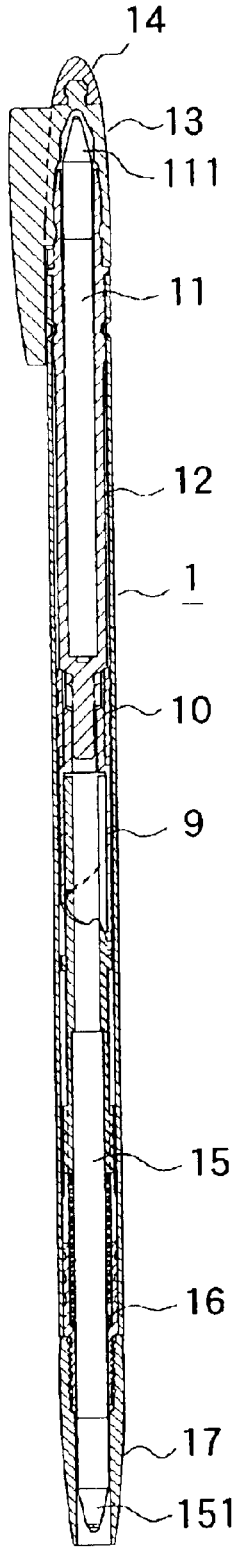
FIG. 18 is a longitudinal sectional view of a composite writing implement in a second embodiment according to the present invention.

Referring to FIG. 18 showing a composite writing implement in a second embodiment according to the present invention, the composite writing implement is provided with a barrel, a barrel cap 17 attached to a front end part of the barrel, two ballpoint refills 11 and 15 contained in the barrel, and a stylus tip 14. The ballpoint refill 11 contains a red ink that is used when necessary, and the ballpoint refill 15 contains a black ink that is used for ordinary writing. The stylus tip 14 is put on a stylus Up holding projection formed in a cap 13. The ballpoint refill 15 is combined with a rotary cam member 9 by a connecting mechanism similar to that connecting the pencil lead tank 2 and the rotary cam member 9 of the composite writing implement in the first embodiment. The structural relation between the cap 13, the ballpoint refill 11, the ball-point refill case 12 and the rotary cam member 9 is the same as that between the corresponding components of the composite writing implement in the first embodiment. When the cap 13 is turned, the rotary cam member 9 exerts a force on the ballpoint refill 15 to advance the ballpoint refill 15 in the barrel 1. Consequently, the ballpoint tip 151 of the ballpoint refill 15 projects outside through the open front end of the barrel cap 17. The ballpoint refill 15 is pushed resiliently backward by a spring 16.

Although the cap 13 and the stylus tip 14 are separate members in the foregoing embodiments, the cap 13 and the stylus tip 14 may be replaced with a single member.

As apparent from the foregoing description, according to the present invention, since the three writing elements are arranged coaxially, the number of parts is small, the barrel has a small outside diameter and the composite writing implement is easy to use.

The cap of the composite writing implement provided with the stylus tip enables the use of the composite writing implement as a stylus pen and can be used as an operating member for operating the pencil lead feeder or the ballpoint refill. Since the pencil lead feeder and the ballpoint refill are disposed coaxially in the barrel and the pencil lead feeder and the ballpoint refill case are connected by a simple interlocking mechanism, the pencil lead feeder can be easily operated and the barrel has a very small outside diameter.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. A composite writing implement comprising:

a barrel;

a pencil lead feeder unit axially slidably placed in the barrel;

a ballpoint refill unit disposed behind and coaxially with the pencil lead feeder unit in the barrel; an interlocking means for interlocking the pencil lead feeder unit and the ballpoint refill unit; and a cap capable of being used as a stylus, for covering a ballpoint tip of the ballpoint refill, wherein the pencil lead feeder unit includes a lead tank containing pencil leads, a chuck fixedly connected to the lead tank, a chuck spring urging the lead tank backward together with the chuck, and a chuck ring capable of closely engaging with a front chucking part of the chuck to make the chuck hold a lead; the ballpoint refill unit includes a ballpoint refill, and a ballpoint refill case fixedly holding the ballpoint refill therein;

the interlocking mechanism includes a rotary cam member having a back end part interlocked with a front end part of the ballpoint refill case and a front end part provided with a face cam engaging with a back end of the lead tank of the pencil lead feeder unit;

the cap is connected to the back end part of the ballpoint refill case such that the cap is unable to turn relative to the ballpoint refill case, is able to turn together with the ballpoint refill case, and can be removed from the ballpoint refill case; and the rotary cam member is turned together with the ballpoint refill case by turning the cap to make the pencil lead feeder unit feed a lead.

2. A composite writing implement comprising:

a barrel provided with a detachable barrel cap;

a lead tank axially movably placed in the barrel;

a chuck fixedly connected to a front end part of the lead tank;

a chuck ring loosely mounted on a chucking part of the chuck and capable of fastening the chucking part; a sleeve coaxially surrounding the chuck;

a chuck spring compressed between an annular ridge formed in an inner surface of the sleeve and a front end of the lead tank;

a rotary cam member provided with a face cam in engagement with a back end of the lead tank and capable of advancing the lead tank;

a ballpoint refill case connected to the rotary cam member so as to transmit a turning motion to the rotary cam member;

a ballpoint refill inserted in and held by the ballpoint refill case;

a stopper tube fixedly held in the barrel to position the ballpoint refill case in place; and a cap capable of being used as a stylus and put on a back end part of the ballpoint refill case such that the ballpoint refill case turns together with the cap.

* * * * *